US005701787A

United States Patent [19]

Brill

[11] Patent Number: 5,701,787

[45] Date of Patent: Dec. 30, 1997

[54] SHARPENING GUIDE FOR SNOWBOARDS AND ALPINE SKIS

[76] Inventor: Donald J. Brill, 1815 Gravers La., Wilmington, Del. 19810

[21] Appl. No.: 623,547

[22] Filed: Mar. 29, 1996

[51] Int. Cl.[6] ..... B23D 67/12; B23D 69/02

[52] U.S. Cl. ..... 76/83; 76/88

[58] Field of Search ..... 76/82, 83, 88; 451/558

[56] References Cited

U.S. PATENT DOCUMENTS

| | | | |
|---|---|---|---|
| D. 327,401 | 6/1992 | Howden | D8/91 |
| 493,174 | 3/1893 | McClure | 76/83 |
| 1,196,399 | 8/1916 | Ryan | 76/83 |
| 3,914,839 | 10/1975 | Holdsworth | 29/80 |
| 3,934,287 | 1/1976 | Howard | 7/141 |
| 4,060,013 | 11/1977 | Thompson | 76/83 |
| 4,601,220 | 7/1986 | Yurick, Jr. | 76/83 |
| 4,663,993 | 5/1987 | Weninger et al. | 76/83 |
| 4,998,956 | 3/1991 | Sherman | 76/83 |
| 5,189,845 | 3/1993 | Courchesne | 451/558 |
| 5,499,555 | 3/1996 | Vermillion | 76/83 |

*Primary Examiner*—Hwei-Siu Payer

[57] ABSTRACT

A sharpening guide consisting of a cutting tool supporting spacer and a filing or polishing area locater during the sharpening of the horizontal metal edge surface of alpine skis and snowboards. The right angle spacer is provided with a horizontal base and a vertical side wall. The bottom surface of the horizontal base rests on the ski or snowboard base and the inclined top surface locally supports the cutting tool. The filing or polishing area locater rests on the top surface of the cutting tool and is demountably secured to the vertical member of the spacer. The locater has an elongated tab extending generally from the spacer longitudinally along the cutting tool towards the edge being sharpened. The elongated tab having a member for indicating the location along the cutting tool for contacting the horizontal surface of the metal edge of the ski or snowboard during the sharpening and dressing process. The incline of the cutting tool is established by the thickness of the spacer and the distance between the spacer and the edge being sharpened.

6 Claims, 1 Drawing Sheet

SHARPENING GUIDE FOR SNOWBOARDS AND ALPINE SKIS

BACKGROUND OF THE INVENTION

1. Field of the Invention

This invention relates generally to a cutting tool guide. More specifically, this invention relates to a guide for sharpening the horizontal surface of the metal edge of alpine skis and snowboards.

2. Description of Related Art

The bottom, or base, of alpine skis and snowboards has two regions which come in contact with the snow and ice, a plastic gliding surface and a metal edge at the perimeter of the base. The shape and smoothness of the metal edge are critical for precise turning of skis and snowboards. The metal edge has a horizontal and vertical surface. These two surfaces are commonly sharpened with metal cutting files and polishing stones to shape the edge surfaces, remove burrs and blend nicks.

Ski and snowboard servicers, professional and self-servicers, not having access to expensive automatic metal edge grinding equipment found in some ski servicing shops sharpen the horizontal surface of the metal edge using either a conventional file and polishing stone or a hand held jig holding a file segment. The jig rides along the metal edge of the ski holding a two to five centimeters long file segment filing the surface. Servicers using a conventional file position it generally parallel to the ski base and offset approximately forty-five degrees laterally from the side of the ski or snowboard. Both methods sharpen the edge by working the file or file segment lengthwise along the ski or snowboard.

Conventional files are readily available and have a much longer useful life than the file segments found in hand held jigs with an overall lower cost.

Many alpine skiers and snowboarders prefer the horizontal surface of the metal edge to have a slight angle or bevel up from zero degrees, that is, they prefer this surface not be parallel with the base. Most skiers and snowboarders agree that having the metal surface not parallel enhances the glidability and turning performace of both alpine skis and snowboards. This bevel typically is from one half to three degrees with one degree being the most common. A conventional file resting on the base during filing generates a parallel metal surface. To bevel the horizontal metal edge, the file is inclined to the desired degree by placing a spacer between the base and the file away from the edge being dressed. This spacer is typically created by wrapping tape around the file to a desired thickness. Convention has established that a given number of wraps of tape creates a specific degree of file inclination. Though this method of inclining a file is used by a majority of servicers, the incline may not remain at the desired degree during the filing process. The degree of inclination is not determined solely by the thickness of the spacer. The degree of inclination is a combination of the spacer thickness and the distance between the spacer and the point at which the file or cutting tool contacts the metal edge. This distance is hard to control during the dynamic process of sharpening the metal edge of alpine skis and snowboards. The difficulty of controlling this distance between the spacer and the edge of alpine skis is compounded by the constant change in base width from the wider tip and tail to the much narrower waist.

Therefore, there is a need for an inexpensive conventional file or polishing stone guide which accurately establishes the thickness of the spacer and indicates the correct distance between the cutting area and the spacer during the dressing and sharpening of the horizontal surface of the metal edge of alpine skis and snowboards.

SUMMARY AND OBJECTS OF THE INVENTION

The present invention provides a guide which inexpensively and accurately controls the degree of inclination of a conventional file or other cutting tool during the sharpening of the horizontal surface of the metal alpine ski or snowboard edge. This guide combines a spacer of a fixed thickness, placed between the cutting tool and ski base, with a locating arm indicating the required distance between the spacer and cutting location along the cutting tool. Spacers of varying thicknesses are provided which in turn when combined with the locating arm vary the cutting tool inclination. The incline of the top surface, on which the cutting tool rests, of the various spacers equals the incline of the cutting tool. This inclined top surface of the spacer conveniently assists the servicer in maintaining the desired cutting tool incline and evenly distributes the downward force generated by the servicer across the spacer and onto the ski base. The present invention allows the cutting tool to be rotated laterally as necessary without changing the degree of cutting tool incline. This guide also clamps easily onto a conventional file or rectangular polishing stone by sandwiching the cutting tool between the locating arm and spacer.

It is the main object of this invention to provide a sharpening guide having a spacer locally supporting a file or other cutting tool situated between the tool and ski or snowboard base, and demountably connected to the spacer a locating arm indicating the location along the file or cutting tool for contacting the metal edge of the ski or snowboard during the sharpening process.

It is another object of this invention to provide a guide which can be used with conventional files and polishing stones.

It is a further object of this invention to provide a guide having a spacer with an inclined top surface on which the cutting tool rests equal to the incline of the cutting tool.

It is a further object of this invention to provide a guide having spacers of varying thickness which when combined with the locating arm create corresponding degrees of cutting tool inclination.

DESCRIPTION OF THE PREFERRED EMBODIMENT

Figure 1:
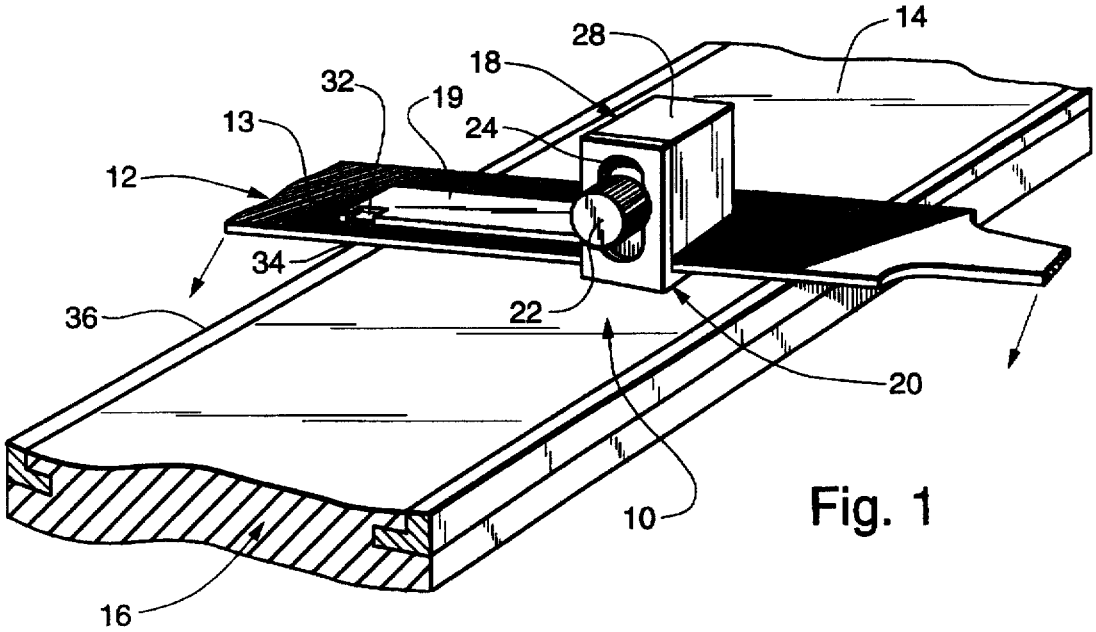
FIG. 1 is a perspective view of the sharpening guide in position on a file resting on the base of an alpine ski.

Referring now to the various Figures of the drawings, the sharpening guide 10 of this invention is shown in FIG. 1 clamped onto a hand file 12 resting on the base 14 of an alpine snow ski 16. Guide 10 is a combination of a right angle spacer 20 which raises hand file 12 locally off the ski base 14 and a locating member 18 on the surface 13 of file 12. Spacer 20 and locating member 18 are fastened together by a thumbscrew 22 passing through slot 24 of spacer 20 into a threaded hole (FIG. 2) 26 of locating member 18.

Sharpening guide 10 may be made of any suitable material, and in the present embodiment is made of plastic.

Figure 2:
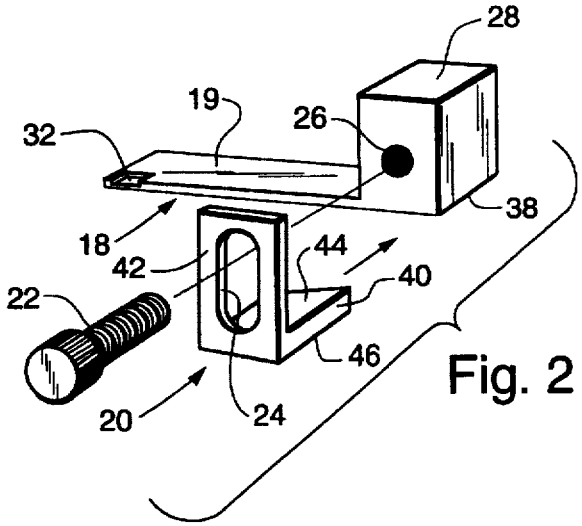
FIG. 2 is a perspective exploded view of the guide assemblage.

Referring now to FIG. 2 there is the preferred embodiment of the various parts of sharpening guide 10. Elongated locating member 18 has a solid cube portion 28 approximately two centimeters square with centrally located threaded hole 26 running horizontally through solid cube 28 for accepting thumbscrew 22. A tab 19 two centimeters wide and two millimeters thick moves out from the base of cube 28 a fixed length, approximately four centimeters. Near the end, away from cube 28, of tab 19 a depression 32 indicates the correct contact point 34 (FIG. 1) between file 12 and metal edge 36 of ski base 14 to create the desired inclination of file 12.

Figure 3:
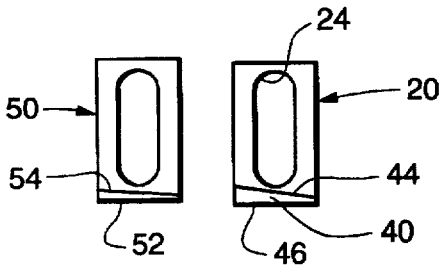
FIG. 3 is a plan view of various spacers illustrating the incline of the cutting tool supporting top surface of the horizontal base.

Continuing to refer for the most part to FIG. 2, spacer 20 has two salient components, a horizontal cutting tool supporting base 40 and juxtaposed at a right angle, a vertical wall 42. The approximate dimensions of horizontal base 40 are two centimeters wide, three centimeters long, and one millimeter thick. The long side of horizontal base 40 is perpendicular to the longitudinal direction of file 12. The top surface 44 of horizontal base 40 is inclined, best illustrated in FIG. 3, moving parallel to the longitudinal direction of file 12. Vertical wall 42 is parallel to the side of inclined top surface 44 and at a right angle to the bottom surface 46 of horizontal base 40. The dimensions of vertical wall 42 are approximately two centimeters square and four millimeters thick containing a centrally located, vertically disposed, through slot 24.

To join file 12 with sharpening guide 10, file 12 is placed onto the top surface 44 of support base 40, then locater 18 is placed on hand file 12 and aligned with spacer 20. With file 12 between, locater 18 and support base 40 of guide 10 are fastened together by thumbscrew 22 passing through slot 24 and turned into threaded hole 26. The metal teeth of file 12 bite into the bottom surface 38 of locater 18 and top surface 44 of support base 40 of spacer 20 which facilitates the file 12 and guide 10 moving in unison during the sharpening process of horizontal metal edge 36. The incline of file 12 can be changed to another predetermined degree of inclination by exchanging spacer 20 with (FIG. 3) spacer 50 each having a horizontal base 40 and 52 of differing thickness and a corresponding top surface 44 and 54 incline.

Those skilled in the art will appreciate that numerous modifications may be made to the preferred embodiment without departing from the present invention. Such modifications are embraced within the scope of this invention as set forth in the appended claims.

I claim:

1. A sharpening guide for use with a cutting tool during the sharpening of a horizontal metal edge surface of an alpine ski or snowboard comprising:

an angular member comprising a horizontal base having an inner upper surface and an outer bottom surface and a generally vertical side wall having a vertically disposed through slot;

an elongated member demountably connected to the vertical side wall of the angular member comprising, a cube portion which engages an inner surface of said vertical side wall and has a centrally located and threaded hole perpendicular to the plane of the wall of the cube portion that engages said vertical side wall of said angular member, a tab extending from a base of said cube portion and a means to indicate a contact point between the cutting tool and the horizontal metal edge surface of the alpine ski, a means for retaining the sharpening guide in a fixed relationship to said cutting tool, wherein the inner upper surface of the horizontal base of said angular member locally supports said cutting tool and the elongated member rests on the top surface of said cutting tool.

2. The sharpening guide of claim 1 wherein demountably connecting said angular member and said elongated member comprises a thumbscrew passing through the vertically disposed through slot of said side wall of said angular member and being rotated into the centrally located and threaded hole of said cube portion of said elongated member.

3. The sharpening guide of claim 1 wherein the means for indicating the contact point between said cutting tool and said horizontal metal edge surface of said alpine ski is a depression in said tab of said elongated member.

4. The sharpening guide of claim 1 wherein the means for retaining said sharpening guide in a fixed relationship to said cutting tool comprises said angular member and said elongated member wherein said cutting tool is clamped between said horizontal base of said angular member and said elongated member.

5. The sharpening guide of claim 1 wherein the outer bottom surface of said horizontal base of said angular member engages a base of said alpine ski.

6. The sharpening guide of claim 1 wherein said inner upper surface of said horizontal base of said angular member is generally inclined.

* * * * *